US007033469B2

(12) United States Patent
Weirauch, Jr. et al.

(10) Patent No.: US 7,033,469 B2
(45) Date of Patent: Apr. 25, 2006

(54) STABLE INERT ANODES INCLUDING AN OXIDE OF NICKEL, IRON AND ALUMINUM

(75) Inventors: Douglas A. Weirauch, Jr., Murrysville, PA (US); Joseph M. Dynys, New Kensington, PA (US); Robert A. DiMilia, Greensburg, PA (US); Siba P. Ray, Murrysville, PA (US); Xinghua Liu, Murrysville, PA (US); Frankie E. Phelps, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 426 days.

(21) Appl. No.: 10/291,874

(22) Filed: Nov. 8, 2002

(65) Prior Publication Data

US 2004/0089558 A1 May 13, 2004

(51) Int. Cl.
*C25B 11/04* (2006.01)

(52) U.S. Cl. ..... 204/291; 204/243.1; 204/247.3; 205/372; 205/380; 205/385; 252/519.1; 252/513; 252/514; 252/518.1; 252/521.2; 423/594

(58) Field of Classification Search ..... 204/243.1, 204/243.3, 291; 252/519.1, 513, 514, 518.1, 252/521.2; 205/372, 380, 385; 423/594
See application file for complete search history.

(56) References Cited

U.S. PATENT DOCUMENTS

| | | | | |
|---|---|---|---|---|
| 3,711,397 | A * | 1/1973 | Martinsons | 205/474 |
| 3,996,117 | A | 12/1976 | Graham et al. | |
| 4,039,401 | A | 8/1977 | Yamada et al. | |
| 4,190,516 | A | 2/1980 | Kajimaya et al. | |
| 4,288,302 | A | 9/1981 | de Nora et al. | |
| 4,290,859 | A | 9/1981 | Oda et al. | |
| 4,320,321 | A | 3/1982 | Alexandrov et al. | |
| 4,374,050 | A | 2/1983 | Ray | |
| 4,374,761 | A | 2/1983 | Ray | |
| 4,397,729 | A | 8/1983 | Duruz et al. | |
| 4,399,008 | A | 8/1983 | Ray | |
| 4,455,211 | A | 6/1984 | Ray et al. | |
| 4,472,258 | A | 9/1984 | Secrist et al. | |
| 4,478,693 | A | 10/1984 | Ray | |
| 4,552,630 | A | 11/1985 | Wheeler et al. | |
| 4,582,585 | A | 4/1986 | Ray | |
| 4,584,172 | A | 4/1986 | Ray et al. | |
| 4,620,905 | A | 11/1986 | Tarcy et al. | |
| 4,871,437 | A | 10/1989 | Marschman et al. | |
| 4,871,438 | A | 10/1989 | Marschman et al. | |
| 4,960,494 | A | 10/1990 | Nguyen et al. | |
| 5,019,225 | A | 5/1991 | Darracq et al. | |
| 5,137,867 | A | 8/1992 | Ray et al. | |
| 5,254,232 | A | 10/1993 | Sadoway | |
| 5,279,715 | A | 1/1994 | La Camera et al. | |
| 5,284,562 | A | 2/1994 | Beck et al. | |
| 5,378,325 | A | 1/1995 | Dastolfo, Jr. et al. | |
| 5,626,914 | A | 5/1997 | Ritland et al. | |
| 5,794,112 | A | 8/1998 | Ray et al. | |
| 5,865,980 | A | 2/1999 | Ray et al. | |
| 5,938,914 | A | 8/1999 | Dawless et al. | |
| 6,126,799 | A | 10/2000 | Ray et al. | |
| 6,187,168 | B1 | 2/2001 | LaCamera et al. | |
| 6,217,739 | B1 | 4/2001 | Ray et al. | |
| 6,372,119 | B1 | 4/2002 | Ray et al. | |
| 6,416,649 | B1 | 7/2002 | Ray et al. | |
| 6,423,195 | B1 | 7/2002 | Ray et al. | |
| 6,423,204 | B1 * | 7/2002 | Ray et al. | 205/387 |
| 6,821,312 | B1 | 11/2004 | Ray et al. | |

FOREIGN PATENT DOCUMENTS

| | | |
|---|---|---|
| EP | 030834 A2 | 6/1981 |
| WO | WO 02/066710 A1 | 8/2002 |

OTHER PUBLICATIONS

U.S. Appl. No. 10/291,122, filed Nov. 8, 2002, DiMilia et al.
Belyaev, A.I., "Electrolysis of Aluminum with Nonburning Ferrite Anodes", *Legkie Metal.,* 7(1): 7-20, 1938, no month available.
Billehaug, Kari, et al., "Inert Anodes for Aluminum Electrolysis in Hall-Héroult Cells (I)", *Aluminum,* pp 146-150, 1981, no month available.
Billehaug, Kari, et al., "Inert Anodes for Aluminum Electrolysis in Hall- Héroult Cells (II)", *Aluminum,* pp 228-231, 1981, no month available.

* cited by examiner

*Primary Examiner*—Bruce F. Bell
(74) *Attorney, Agent, or Firm*—Daniel P. Cillo; Eckert Seamans Cherin & Mellott, LLC

(57) ABSTRACT

Ceramic inert anodes useful for the electrolytic production of aluminum are disclosed. The inert anodes comprise oxides of Ni, Fe and Al. The Ni—Fe—Al oxide inert anode materials have sufficient electrical conductivity at operation temperatures of aluminum production cells, and also possess good mechanical stability. The Ni—Fe—Al oxide inert anodes may be used to produce commercial purity aluminum.

59 Claims, 6 Drawing Sheets

STABLE INERT ANODES INCLUDING AN OXIDE OF NICKEL, IRON AND ALUMINUM

FIELD OF THE INVENTION

The present invention relates to inert anodes useful for the electrolytic production of aluminum, and more particularly relates to stable inert anodes comprising an oxide of nickel, iron and aluminum.

BACKGROUND OF THE INVENTION

The energy and cost efficiency of aluminum smelting can be significantly reduced with the use of inert, non-consumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,794,112, 5,865,980, 6,126,799, 6,217,739, 6,372,119, 6,416,649, 6,423,204 and 6,423,195, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not enter into unwanted reactions with oxygen or corrode in an oxygen-containing atmosphere. It should be thermally stable at temperatures of about 1,000° C., and should have good mechanical strength. Furthermore, the anode material must have sufficient electrical conductivity at the smelting cell operating temperatures, e.g., about 900–1,000° C., so that the voltage drop at the anode is low and stable during anode service life.

SUMMARY OF THE INVENTION

The present invention provides a ceramic inert anode for use in electrolytic aluminum production cells. The ceramic comprises an oxide of nickel, iron and aluminum. In one embodiment, the Ni—Fe—Al oxide may consist essentially of a single phase at an operation temperature of the electrolytic aluminum production cell.

An aspect of the present invention is to provide an inert anode for use in an electrolytic aluminum production cell which comprises an electrically conductive oxide of nickel, iron and aluminum.

Another aspect of the present invention is to provide an electrolytic aluminum production cell comprising a molten salt bath comprising an electrolyte and aluminum oxide, a cathode, and an inert anode comprising electrically conductive Ni—Fe—Al oxide.

A further aspect of the present invention is to provide a method of making an inert anode. The method includes the steps of mixing nickel oxide, iron oxide and aluminum oxide in controlled ratios, and consolidating the mixture to form a ceramic material comprising electrically conductive Ni—Fe—Al oxide.

Another aspect of the present invention is to provide a method of making commercial purity aluminum. The method includes the steps of passing current through a Ni—Fe—Al oxide inert anode and a cathode through a bath comprising an electrolyte and aluminum oxide, and recovering aluminum comprising a maximum of 0.2 weight percent Fe.

These and other aspects of the present invention will be more apparent from the following description.

DETAILED DESCRIPTION OF PREFERRED EMBODIMENTS

Figure 1:
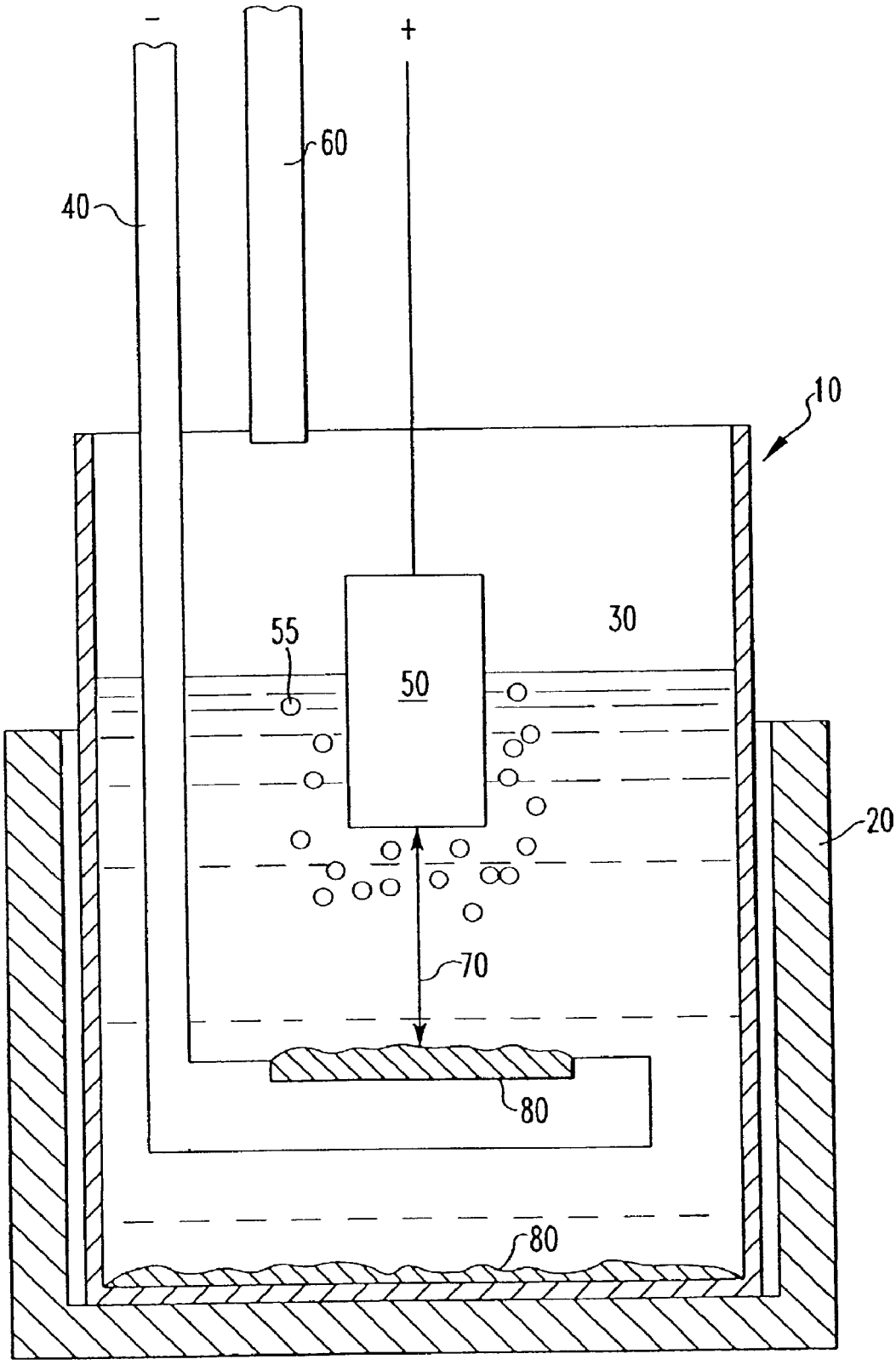
FIG. 1 is a partially schematic sectional view of an electrolytic cell including a Ni—Fe—Al oxide inert anode in accordance with the present invention.

FIG. 1 schematically illustrates an electrolytic cell for the production of commercial purity aluminum which includes a Ni—Fe—Al oxide ceramic inert anode in accordance with an embodiment of the present invention. The cell includes an inner crucible 10 inside a protection crucible 20. A cryolite bath 30 is contained in the inner crucible 10, and a cathode 40 is provided in the bath 30. A Ni—Fe—Al oxide inert anode 50 is positioned in the bath 30. An alumina feed tube 60 extends partially into the inner crucible 10 above the bath 30. The cathode 40 and Ni—Fe—Al oxide inert anode 50 are separated by a distance 70 known as the anode-cathode distance (ACD). Commercial purity aluminum 80 produced during a run is deposited on the cathode 40 and on the bottom of the crucible 10. Alternatively, the cathode may be located at the bottom of the cell, and the aluminum produced by the cell forms a pad at the bottom of the cell.

As used herein, the term "Ni—Fe—Al oxide inert anode" means a substantially non-consumable, ceramic-containing anode which possesses satisfactory corrosion resistance, electrical conductivity, and stability during the aluminum production process. The inert anode may comprise a monolithic body of the Ni—Fe—Al oxide. Alternatively, the inert anode may comprise a surface layer or coating on the inert anode. In this case, the substrate material of the anode may be any suitable material such as metal, ceramic and/or cermet materials. At least a portion of the inert anode of the present invention preferably comprises at least about 90 weight percent of the Ni—Fe—Al oxide ceramic, for example, at least about 95 weight percent. In a particular embodiment, at least a portion of the inert anode is made entirely of the present ceramic material.

In accordance with an embodiment of the present invention, the Ni—Fe—Al oxide may have selected Ni/(Ni+Fe+Al), Fe/(Ni+Fe+Al) and Al/(Ni+Fe+Al) mole ratios as set forth in Table 1.

TABLE 1

| | Mole Ratios of Ni—Fe—Al Oxides | | |
|---|---|---|---|
| | Ni/(Ni + Fe + Al) | Fe/(Ni + Fe + Al) | Al/(Ni + Fe + Al) |
| Typical | 0.2 to 0.6 | 0.02 to 0.8 | 0 to 0.76 |
| Preferred | 0.25 to 0.35 | 0.032 to 0.75 | 0.001 to 0.713 |
| More Preferred | 0.28 to 0.33 | 0.033 to 0.72 | 0.005 to 0.684 |

Figure 2:
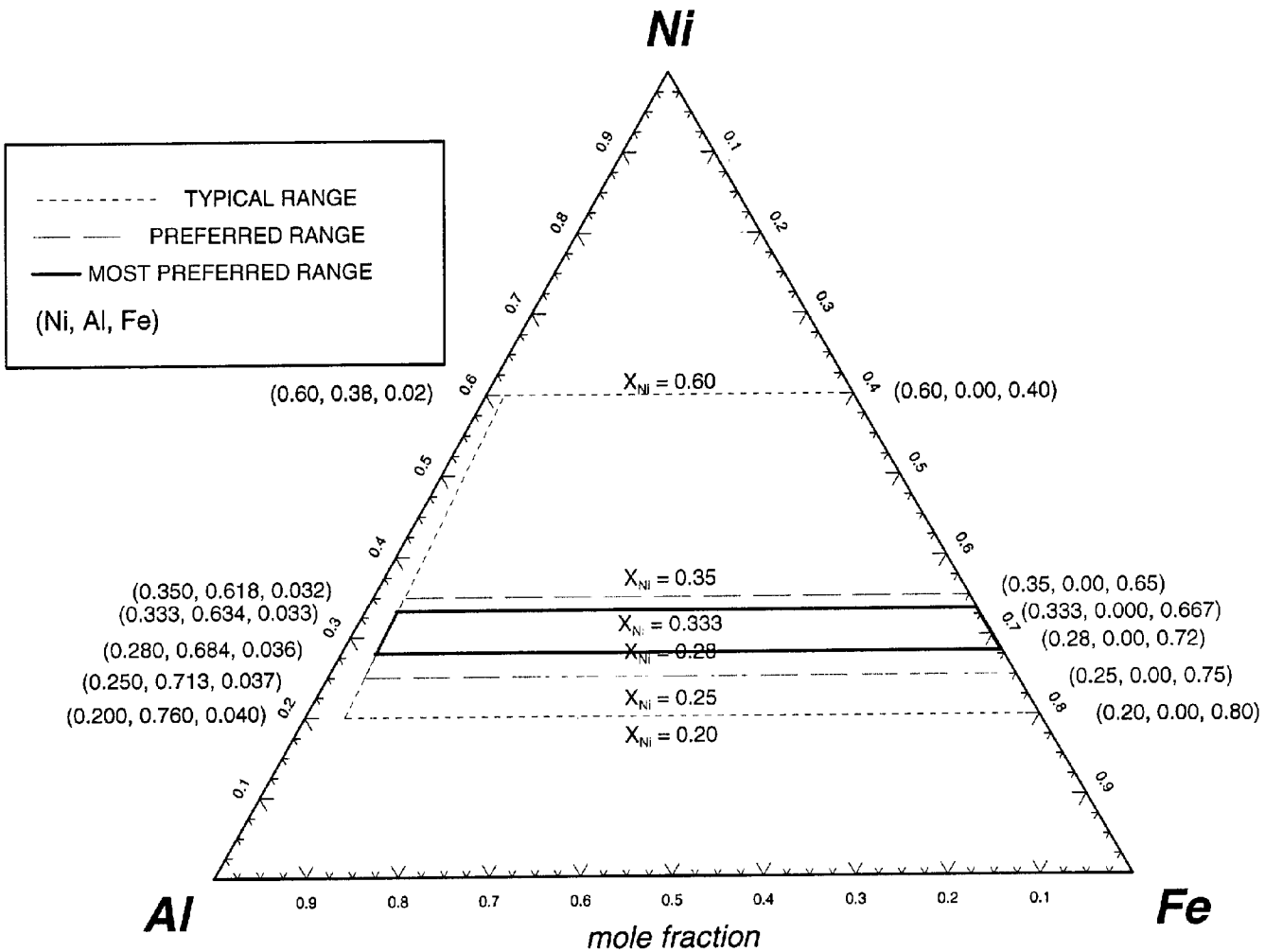
FIG. 2 is a ternary diagram of Ni, Fe and Al mole fractions, illustrating Ni—Fe—Al oxide compositions in accordance with embodiments of the present invention.

FIG. 2 illustrates the typical, preferred and more preferred Ni, Fe and Al mole ratios listed in Table 1.

In one embodiment, the Al may substitute for a portion of the Ni in the nickel ferrite spinel structure, i.e., the Fe/(Ni+Fe+Al) mole ratio is maintained at about 0.33. In another embodiment, the Al may substitute for a portion of the Fe in the nickel ferrite spinel structure, i.e., the Ni/(Ni+Fe+Al) mole ratio is maintained at about 0.33. In a further embodiment, the Al may substitute for a portion of the Ni and a portion of the Fe in the nickel ferrite spinel structure, i.e., both the Ni/(Ni+Fe+Al) and Fe/(Ni+Fe+Al) mole ratios are less than about 0.33.

In an embodiment of the present invention, the Al/(Ni+Fe+Al) mole ratio is relatively low, e.g., less than about 0.25. For example, the Al/(Ni+Fe+Al) mole ratio may be from about 0.05 to about 0.20. In another embodiment, the Al/(Ni+Fe+Al) mole ratio may be relatively high, e.g., greater than about 0.33. For example, the Al/(Ni+Fe+Al) mole ratio may be from about 0.35 to about 0.70.

The term "single phase" as used herein in accordance with an embodiment of the present invention means that the Ni—Fe—Al oxide consists essentially of one phase, such as a spinel, at a given temperature. For example, the Ni—Fe—Al oxide may be an aluminum nickel ferrite spinel which is substantially single-phase at a cell operating temperature of from about 900 to 1,000° C. The Ni—Fe—Al oxide may also be single-phase at a sintering temperature of the material, e.g., from 1,200 to 1,650° C. A substantially single phase microstructure may provide improved mechanical properties because the material does not undergo deleterious phase changes when exposed to varying temperatures such as the temperatures experienced during cell operation or during sintering. The formation of unwanted second phases can cause problems, such as cracking of the inert anodes during heat-up or cool-down of the anodes, due to differences in volumes and densities of the different phases that are formed.

The term "electrically conductive" as used herein means that the Ni—Fe—Al oxide has a sufficient electrical conductivity at the operation temperature of the electrode. For example, the electrically conductive Ni—Fe—Al oxide has an electrical conductivity of at least 0.25 S/cm at a temperature of from 900 to 1,000° C., typical of aluminum production cells.

As used herein, the term "commercial purity aluminum" means aluminum which meets commercial purity standards upon production by an electrolytic reduction process. The commercial purity aluminum may comprise a maximum of 0.2 weight percent Fe. For example, the commercial purity aluminum comprises a maximum of 0.15 or 0.18 weight percent Fe. In one embodiment, the commercial purity aluminum comprises a maximum of 0.13 weight percent Fe. The commercial purity aluminum may also comprise a maximum of 0.034 weight percent Ni. For example, the commercial purity aluminum may comprise a maximum of 0.03 weight percent Ni. The commercial purity aluminum may also meet the following weight percentage standards for other types of impurities: 0.1 maximum Cu, 0.2 maximum Si, 0.030 maximum Zn and 0.03 maximum Co. For example, the Cu impurity level may be kept below 0.034 or 0.03 weight percent, and the Si impurity level may be kept below 0.15 or 0.10 weight percent. It is noted that for every numerical range or limit set forth herein, all numbers with the range or limit including every fraction or decimal between its stated minimum and maximum, are considered to be designated and disclosed by this description.

The Ni—Fe—Al oxide may optionally include additives and/or dopants in amounts up to about 50 weight percent or more. In one embodiment, the additive(s) may be present in relatively minor amounts, for example, from about 0.1 to about 10 weight percent. Suitable additives include metals such as Al, Cu, Ag, Pd, Pt and the like, e.g., in amounts of from about 0.1 to about 10 weight percent or more of the ceramic inert anode. Suitable oxide additives or dopants include oxides of Al, Co, Cr, Ga, Ge, Hf, In, Ir, Mo, Mn, Nb, Os, Re, Rh, Ru, Se, Si, Sn, Ti, V, W, Zr, Li, Ca, Ce, Y and F, e.g., in amounts of from about 0.1 to about 50 weight percent or higher. For example, the additives and dopants may include oxides of Mn, Nb, Ti, V, Zr and F. The dopants may be used, for example, to increase the electrical conductivity of the ceramic inert anode. It is also desirable to stabilize electrical conductivity during operation of the Hall cell. This may be achieved by the addition of suitable dopants and/or additives.

The additives and dopants may be added as starting materials during production of the inert anodes. Alternatively, the additives and dopants may be introduced into the ceramic during sintering operations, or during operation of the cell. For example, the additives and dopants may be provided from the molten bath or from the atmosphere of the cell. The additives and dopants may be used, for example, to increase the electrical conductivity of the ceramic inert anode.

The Ni—Fe—Al oxides of the present invention have been found to possess sufficient electrical conductivity at the operation temperature of the cell which remains stable during operation of the cell. At temperatures of from 900 to 1,000° C., typical of operating aluminum production cells, the electrical conductivity of the Ni—Fe—Al oxide materials is preferably greater than about 0.25 S/cm, for example, greater than about 0.5 S/cm. When the Ni—Fe—Al oxide material is used as a coating on the anode, an electrical conductivity of at least 1 S/cm may be particularly preferred. When the Ni—Fe—Al oxide is used as a monolithic body of the anode, an electric conductivity of at least 2 S/cm may be preferred.

The Ni—Fe—Al inert anodes may be formed by techniques such as powder sintering, sol-gel processes, chemical processes, co-precipitation, slip casting and spray forming. The starting materials may be provided in the form of nickel and iron oxides. Alternatively, the starting materials may be provided in other forms, such as nitrates, halides and the like. Preferably, the inert anodes are formed by powder techniques in which powders comprising nickel, iron and aluminum oxides and any optional additives or dopants are pressed and sintered. The inert anode may comprise a monolithic component of such materials, or may comprise a substrate having at least one coating or layer of the Ni—Fe—Al oxide material.

The nickel oxide, iron oxide and aluminum oxide starting powders, e.g., NiO, $Fe_2O_3$ and $Al_2O_3$, may be blended in a mixer. Optionally, the blended ceramic powders may be ground to a smaller size before being transferred to a furnace where they are calcined, e.g., for 0.1 to 12 hours at 1,050 to 1,250° C. The oxide mixture may be ground in a ball mill to an average particle size of approximately 10 microns. The fine oxide particles are blended with a polymeric binder/plasticizer and water to make a slurry. About 0.1–10 parts by weight of an organic polymeric binder may be added to 100 parts by weight of the oxide particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 0.8–3 parts by weight of the binder are added to 100 parts by weight of the oxides. The slurry contains, e.g., about 60 weight percent solids and about 40 weight percent water. Spray drying the slurry produces dry agglomerates of the oxides and binders. The spray dried oxide material may be pressed, for example, at 10,000 to 40,000 psi, into anode shapes. A pressure of about 20,000 psi is particularly suitable for many applications.

The pressed shapes may be sintered in an oxygen-containing atmosphere such as air, or in argon/oxygen, nitrogen/oxygen, $H_2/H_2O$ or $CO/CO_2$ gas mixtures, as well as nitrogen. Sintering temperatures of about 1,200–1,650° C. may be suitable. For example, the furnace may be operated at about 1,350–1,550° C. for 2–4 hours. The sintering process burns out any polymeric binder from the anode shapes.

The sintered anode may be connected to a suitable electrically conductive support member within an electrolytic metal production cell by means such as welding, brazing, mechanically fastening, cementing and the like. The inert anode may include a ceramic as described above successively connected in series to a metal and/or cermet transition region and a nickel end. A nickel or nickel-chromium alloy rod may be welded to the nickel end. The metal transition region may include, for example, sintered metal powders and/or small spheres of copper or the like. The cermet transition region may include, for example, four layers of graded composition, ranging from 25 weight percent Ni adjacent the ceramic end and then 50, 75 and 100 weight percent Ni, balance the oxide powders described above.

We prepared Ni—Fe—Al oxide inert anode compositions of varying Ni, Fe and Al molar amounts in accordance with the procedures described above having a diameter of about ⅝ inch and a length of about 5 inches. The starting oxide powders were dry mixed, calcined, wet ground, slurried with organic binders, and spray dried to form a free-flowing powder, followed by isostatic pressing at 30,000 psi and sintering at 1,400 to 1,650° C. in an air atmosphere. Table 2 lists some Ni—Fe—Al oxide compounds that were produced. The samples listed in Table 2 were sintered in air at the temperatures listed. Table 2 also lists electrical conductivities of some of the Ni—Fe—Al oxide compositions at temperatures of 900, 960 and 1,000° C.

TABLE 2

Ni—Fe—Al Oxide Compositions

| Sample | Mole Ratio | | | Electrical Conductivity (S/cm) | | | Sintering Temp |
|---|---|---|---|---|---|---|---|
| # | Ni/(Ni + Fe + Al) | Fe/(Ni + Fe + Al) | Al/(Ni + Fe + Al) | 900° C. | 960° C. | 1,000° C. | (° C.) |
| 1 | 0.33 | 0.583 | 0.083 | 0.77 | 0.88 | 0.96 | 1,500 |
| 2 | 0.333 | 0.583 | 0.083 | 3.12 | 3.44 | 3.71 | 1,554 |
| 3 | 0.314 | 0.343 | 0.343 | 0.33 | 0.41 | 0.47 | 1,500 |
| 4 | 0.315 | 0.587 | 0.098 | 3.56 | 4.00 | 4.27 | 1,500 |
| 5 | 0.39 | 0.48 | 0.13 | | | | 1,500 |
| 6 | 0.42 | 0.47 | 0.11 | | | | 1,500 |
| 7 | 0.36 | 0.60 | 0.04 | | | | 1,500 |
| 8 | 0.216 | 0.53 | 0.254 | | | | 1,500 |
| 9 | 0.33 | 0.457 | 0.21 | | | | 1,500 |
| 10 | 0.37 | 0.60 | 0.03 | | | | 1,500 |
| 11 | 0.333 | 0.50 | 0.167 | | | | 1,500 |
| 12 | 0.32 | 0.50 | 0.18 | | | | 1,500 |
| 13 | 0.33 | 0.57 | 0.10 | 2.37 | 2.64 | 2.82 | 1,500 |
| 14 | 0.33 | 0.47 | 0.20 | 0.28 | 0.34 | 0.40 | 1,500 |
| 15 | 0.33 | 0.33 | 0.33 | 0.15 | 0.18 | | 1,500 |
| 16 | 0.317 | 0.667 | 0.016 | 1.33 | 1.94 | | 1,300 |
| 17 | 0.30 | 0.667 | 0.033 | 5.55 | 6.01 | 6.24 | 1,300 |
| 18 | 0.267 | 0.667 | 0.086 | 1.87 | 2.94 | 4.01 | 1,300 |
| 19 | 0.167 | 0.667 | 0.167 | 0.44 | 0.82 | 1.41 | 1,300 |
| 20 | 0.33 | 0.57 | 0.10 | 2.05 | 2.30 | 2.49 | 1,400 |
| 21 | 0.33 | 0.47 | 0.20 | 0.27 | 0.33 | 0.39 | 1,400 |
| 22 | 0.33 | 0.33 | 0.33 | 0.13 | 0.17 | 0.20 | 1,400 |
| 23 | 0.33 | 0.57 | 0.10 | 2.17 | 2.48 | 2.68 | 1,450 |
| 24 | 0.33 | 0.47 | 0.20 | 0.27 | 0.33 | 0.38 | 1,450 |
| 25 | 0.33 | 0.33 | 0.33 | 0.16 | 0.20 | 0.23 | 1,450 |
| 26 | 0.33 | 0.20 | 0.47 | <0.01 | <0.01 | <0.01 | 1,650 |
| 27 | 0.33 | 0 | 0.67 | <0.01 | <0.01 | <0.01 | 1,650 |
| 28 | 0.31 | 0.023 | 0.67 | 0.05 | 0.07 | 0.08 | 1,650 |
| 29 | 0.33 | 0.33 | 0.33 | 0.25 | 0.30 | 0.33 | 1,650 |
| 30 | 0.37 | 0.43 | 0.20 | 1.92 | 2.06 | 2.07 | 1,665 |
| 31 | 0.333 | 0.433 | 0.233 | 1.03 | 1.07 | | 1,665 |

Figure 3:
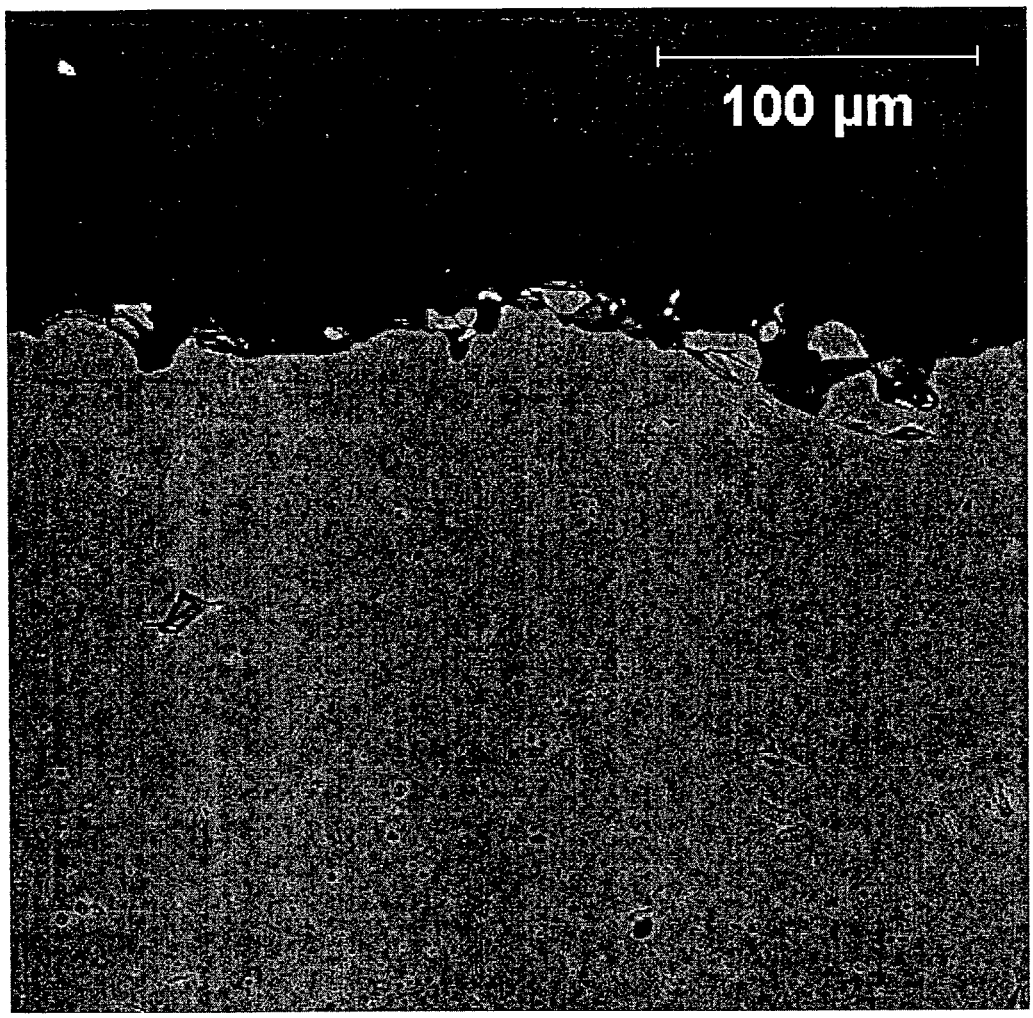
FIG. 3 is a micrograph of a Ni—Fe—Al oxide inert anode material.

FIG. 3 is a micrograph of a Ni—Fe—Al oxide inert anode material corresponding to Sample No. 20 listed in Table 2 having a Ni/Fe/Al mole amount of 0.33/0.57/0.10. As shown in the micrograph, the Ni—Fe—Al oxide comprises a single phase.

Figure 4:
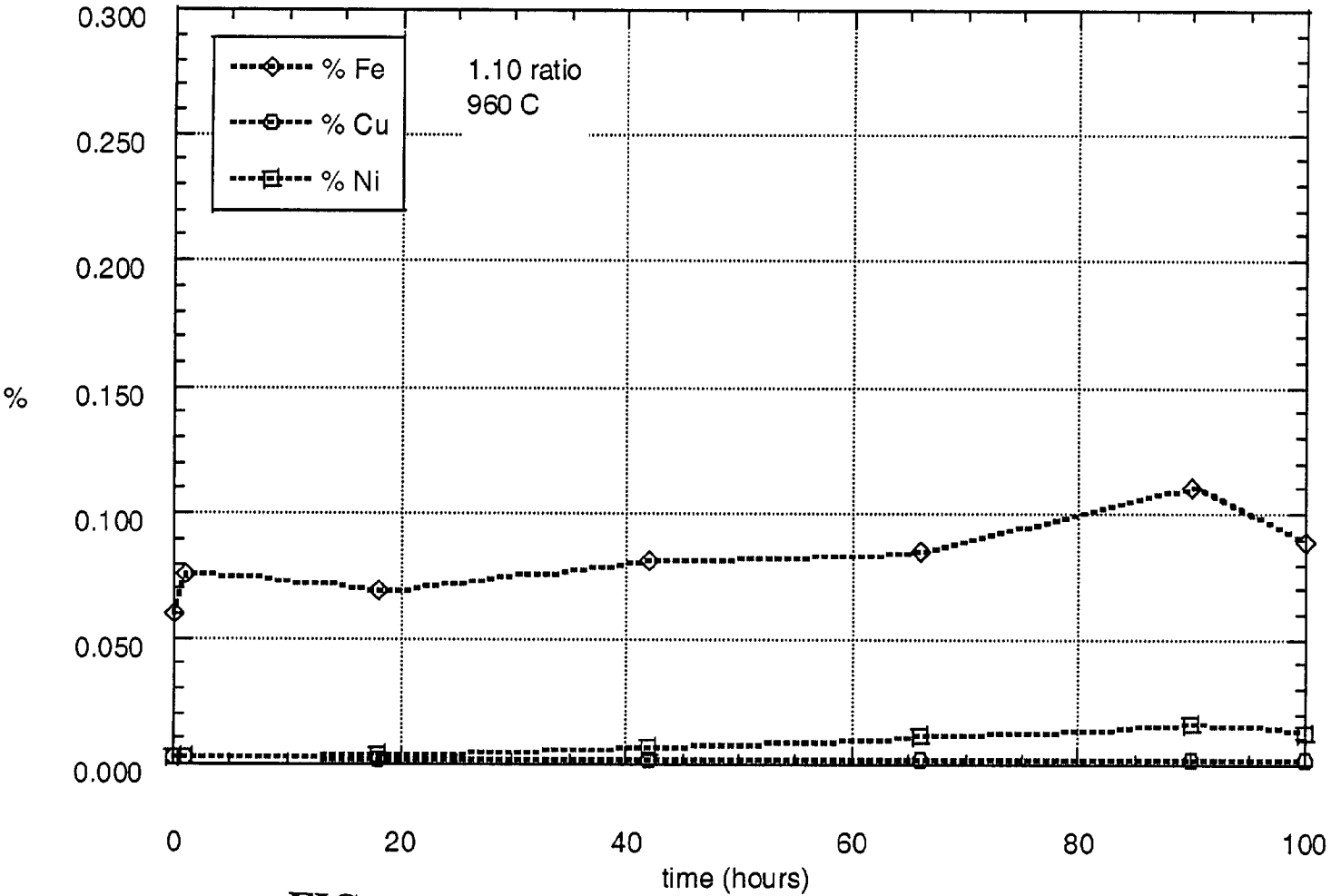
FIGS. 4–6 are graphs of aluminum impurity levels from aluminum production test cells operated with Ni—Fe—Al oxide anodes of the present invention.
Figure 5:
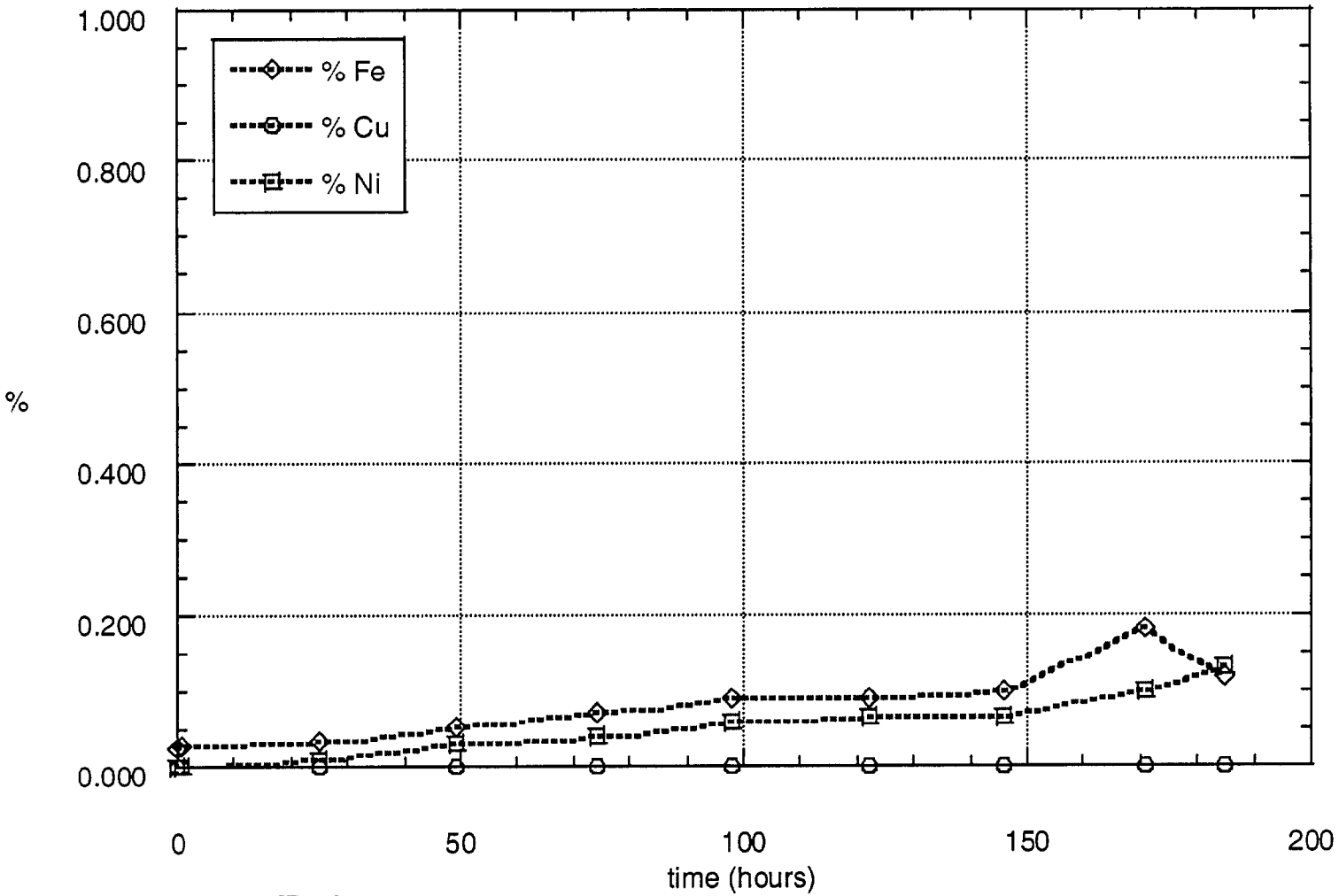
Figure 6:
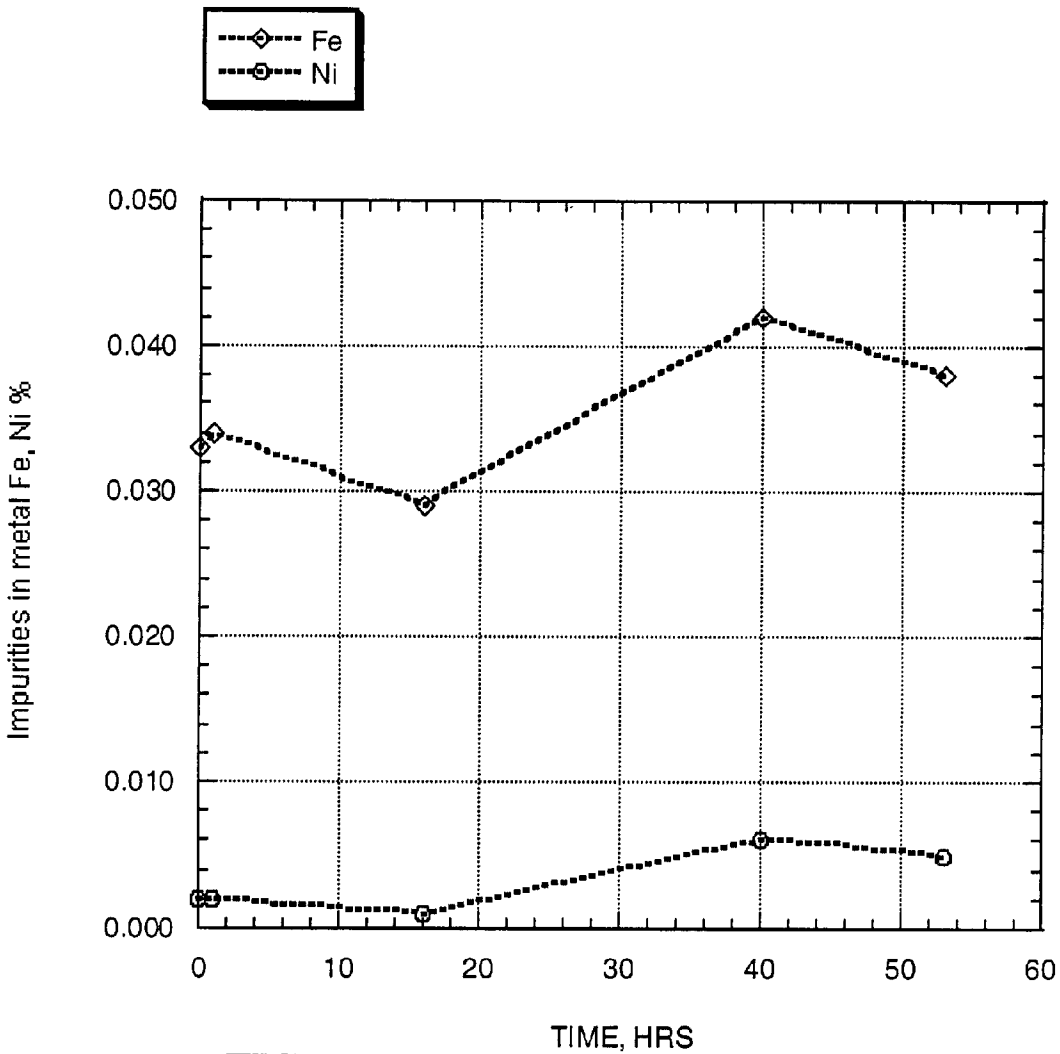

Sample Nos. 17, 1 and 6 listed in Table 2 were evaluated in a Hall-Heroult test cell similar to that schematically illustrated in FIG. 1. The cell was operated for over 50 hours at 960° C. with an aluminum fluoride to sodium fluoride bath ratio of 1.1 and alumina concentration maintained near saturation at about 7–7.5 weight percent. The impurity concentrations in the aluminum produced by the test cell are graphically shown in FIGS. 4–6. FIG. 4 shows impurity levels for Sample No. 17 having Ni/Fe/Al molar amounts of 0.30/0.667/0.033. FIG. 5 shows impurity levels for Sample No. 1 having Ni/Fe/Al molar amounts of 0.333/0.583/0.083. FIG. 6 shows impurity levels for Sample No. 6 having Ni/Fe/Al molar amounts of 0.42/0.47/0.11. The results illustrated in FIGS. 4–6 demonstrate low levels of aluminum contamination by the ceramic inert anodes. In particular, Fe, Ni and Cu impurity levels are very low. In addition, the inert anode wear rate was extremely low.

The present ceramic inert anodes are particularly useful in electrolytic cells for aluminum production operated at temperatures in the range of about 800–1,000° C. A typical cell operates at a temperature of about 900–980° C., for example, about 930–970° C. An electric current is passed between the inert anode and a cathode through a molten salt bath comprising an electrolyte and an oxide of the metal to be collected. In a preferred cell for aluminum production, the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

Having described the presently preferred embodiments, it is to be understood that the invention may be otherwise embodied within the scope of the appended claims.

What is claimed is:

1. An inert anode for use in an electrolytic aluminum production cell, the inert anode comprising an electrically conductive oxide of nickel, iron and aluminum having an aluminum mole ratio Al/(Ni+Fe+Al) of up to about 0.76.

2. The inert anode of claim 1, wherein the aluminum mole ratio Al/(Ni+Fe+Al) is from about 0.001 to about 0.713.

3. The inert anode of claim 1, wherein the aluminum mole ratio Al/(Ni+Fe+Al) is from about 0.005 to about 0.684.

4. The inert anode of claim 1, wherein the oxide of nickel, iron and aluminum has a nickel mole ratio Ni/(Ni+Fc+Al) of from about 0.2 to about 0.6.

5. The inert anode of claim 4, wherein the nickel mole ratio Ni/(Ni+Fe+Al) is from about 0.25 to about 0.35.

6. The inert anode of claim 4, wherein the nickel mole ratio Ni/(Ni+Fe+Al) is from about 0.28 to about 0.33.

7. The inert anode of claim 1, wherein the oxide of nickel, iron and aluminum has an iron mole ratio Fe/(Ni+Fe+Al) of from about 0.02 to about 0.8.

8. The inert anode of claim 7, wherein the iron mole ratio Fe/(Ni+Fe+Al) is from about 0.032 to about 0.75.

9. The inert anode of claim 7, wherein the iron mole ratio Fe/(Ni+Fe+Al) is from about 0.033 to about 0.72.

10. The inert anode of claim 1, wherein the oxide of nickel, iron and aluminum has an aluminum mole ratio Al/(Ni+Fe+Al) of up to about 0.76, a nickel mole ratio Ni/(Ni+Fe+Al) of from about 0.2 to about 0.6, and an iron mole ratio Fe/(Ni+Fe+Al) of from about 0.02 to about 0.8.

11. The inert anode of claim 1, wherein the oxide of nickel, iron and aluminum has an aluminum mole ratio Al/(Ni+Fe+Al) of from about 0.001 to about 0.713, a nickel mole ratio Ni/(Ni+Fe+Al) of from about 0.25 to about 0.35, and an iron niole ratio Fef(Ni+Fe+Al) of from about 0.032 to about 0.75.

12. The inert anode of claim 1, wherein the oxide of nickel, iron and aluminum has an aluminum mole ratio Al/(Ni+Fe+Al) of from about 0.005 to about 0.684, a nickel mole ratio Ni/(Ni+Fe+Al) of from about 0.28 to about 0.33, and an iron mole ratio Fe/(Ni+Fe+Al) of from about 0.033 to about 0.72.

13. The inert anode of claim 1, wherein the oxide of nickel, iron and aluminum has an electrical conductivity of at least 0.25 S/cm at a temperature between 900° C. and 1,000° C.

14. The inert anode of claim 1, wherein the oxide of nickel, iron and aluminum has an electrical conductivity of at least 0.5 S/cm at a temperature between 900° C. and 1,000° C.

15. The inert anode of claim 1, wherein the oxide of nickel, iron and aluminum has an electrical conductivity of at least 1 S/cm at a temperature between 900° C. and 1,000° C.

16. The inert anode of claim 1, wherein the oxide of nickel, iron and aluminum has an electrical conductivity of at least 2 S/cm at a temperature between 900° C. and 1,000° C.

17. The inert anode of claim 1, wherein the oxide of nickel, iron and aluminum is substantially single-phase at an operation temperature of the cell.

18. The inert anode of claim 17, wherein the oxide of nickel, iron and aluminum is also substantially single-phase at a sintering temperature of the oxide.

19. The inert anode of claim 18, wherein the sintering leniperature is from about 1,200 to about 1,650° C.

20. The inert anode of claim 1, wherein the ceramic material is sintered in air.

21. The inert anode of claim 1, wherein the oxide of nickel, iron and aluminum further includes up to about 90 weight percent of an additive.

22. The inert anode of claim 21, wherein the additive comprises at least one material selected from Al, Co, Cr, Ga, Ge, Hf, In, Ir, Mo, Mn, Nb, Os, Re, Rh, Ru, Se, Si, Sn, Ti, V, W, Zr, Li, Ca, Ce, Y and F, and oxides thereof.

23. The inert anode of claim 1, wherein the inert anode comprises a monolithic body of the oxide of nickel, iron and aluminum.

24. The inert anode of claim 1, wherein the inert anode comprises a surface coated with the oxide of nickel, iron and aluminum.

25. An electrolytic aluminum production cell comprising:

a molten salt bath comprising an electrolyte and aluminum oxide;

a cathode; and an inert anode comprising an electrically conductive oxide of nickel, iron and aluminum having an electrical conductivity of at least 0.25 S/cm at a temperature between 900° C. and 1,000° C.

26. The electrolytic aluminum production cell of claim 25, wherein the oxide of nickel, iron and aluminum has an aluminum mole ratio Al/(Ni+Fe+Al) of up to about 0.76, a nickel mole ratio Ni/(Ni+Fe+Al) of from about 0.2 to about 0.6, and an iron mole ratio Fe/(Ni+Fe+Al) of from about 0.02 to about 0.8.

27. The electrolytic aluminum production cell of claim 25, wherein the oxide of nickel, iron and aluminum has an aluminum mole ratio Al/(Ni+Fe+Al) of from about 0.001 to about 0.713, a nickel mole ratio Ni/(Ni+Fe+Al) of from about 0.25 to about 0.35, and an iron mole ratio Fe/(Ni+Fe+Al) of from about 0.032 to about 0.75.

28. The electrolytic aluminum production cell of claim 25, wherein the oxide of nickel, iron and aluminum has an aluminum mole ratio Al/(Ni+Fe+Al) of from about 0.005 to about 0.684, a nickel mole ratio Ni/(Ni+Fe+Al) of from about 0.28 to about 0.33, and an iron mole ratio Fe/(Ni+Fe+Al) of from about 0.033 to about 0.72.

29. The electrolytic aluminum production cell of claim 25, wherein the oxide of nickel, iron and aluminum has at electrical conductivity of at least 0.5 S/cm at a temperature between 900° C. and 1,000° C.

30. The electrolytic aluminum production cell of claim 25, wherein the oxide of nickel, iron and aluminum has an electrical conductivity of at least 1 S/cm at a temperature between 900° C. and 1,000° C.

31. The electrolytic aluminum production cell of claim 25, wherein the oxide of nickel, iron and aluminum has an electrical conductivity of at least 2 S/cm at a temperature between 900° C. and 1,000° C.

32. The electrolytic aluminum production cell of claim 25, wherein the oxide of nickel, iron and aluminum is substantially single-phase at an operation temperature of the cell.

33. The electrolytic aluniinurn production cell of claim 25, wherein the oxide of nickel, iron and aluminum further includes up to about 90 weight percent of an additive.

34. The electrolytic aluminum production cell of claim 33, wherein the additive comprises at least one material selected from Al, Co, Cr, Ga, Ge, Hf, In, Ir, Mo, Mn, Nb, Os, Re, Rh, Ru, Se, Si, Sn, Ti, V, W, Zr, Li, Ca, Ce, Y and F, and oxides thereof.

35. The electrolytic aluminum production cell of claim 25, wherein the inert anode comprises a monolithic body of the oxide of nickel, iron and aluminum.

36. The electrolytic aluminum production cell of claim 25, wherein the inert anode comprises a surface coated with the oxide of nickel, iron and aluminum.

37. A method of making an inert anode, comprising:

mixing nickel oxide, iron oxide and aluminum oxide; and consolidating the mixture to form an electrically conductive oxide of nickel, iron and aluminum having an aluminum mole ratio Al/(Ni+Fe+Al) of up to about 0.76, a nickel mole ratio Ni/(Ni+Fe+Al) of from about 0.2 to about 0.6, and an iron mole ratio Fe/(Ni+Fe+Al) of from about 0.02 to about 0.8.

38. The method of claim 37, wherein the consolidating step comprises pressing the mixture and sintering the mixture.

39. The method of claim 38, wherein the mixture is sintered at a temperature of from about 1,200 to about 1,650° C.

40. The method of claim 38, wherein the mixture is sintered in an oxygen-containing atmosphere.

41. The method of claim 38, wherein the mixture is sintered in air.

42. The method of claim 37, wherein the oxide of nickel, iron and aluminum has an aluminum mole ratio Al/(Ni+Fe+Al) of from about 0.001 to about 0.713, a nickel mole ratio Ni/(Ni+Fe+Al) of front about 0.25 to about 0.35, and an iron mole ratio Fe/(Ni+Fe+Al) of from about 0.032 to about 0.75.

43. The method of claim 37, wherein the oxide of nickel, iron and aluminum has an aluminum mole ratio Al/(Ni+Fe+Al) of from about 0.005 to about 0.684, a nickel mole ratio Ni/(Ni+Fe+Al) of from about 0.28 to about 0.33, and an iron mole ratio Fe/(Ni+Fe+Al) of from about 0.033 to about 0.72.

44. The method of claim 37, wherein the oxide of nickel, iron and aluminum further includes up to about 90 weight percent of an additive.

45. The method of claim 44, wherein the additive comprises at least one material selected from Al, Co, Cr, Ga, Ge, Hf, In, Ir, Mo, Mn, Nb, Os, Re, Rh, Ru, Se, Si, Sn, Ti, V, W, Zr, Li, Ca, Ce, Y and F, and oxides thereof.

46. The method of claim 37, wherein the inert anode comprises a monolithic body of the oxide of nickel, iron and aluminum.

47. The method of claim 37, wherein the inert anode comprises a surface coated with the oxide of nickel, iron and aluminum.

48. A method of producing commercial purity aluminum comprising:

passing current between an inert anode and a cathode through a bath comprising an electrolyte and aluminum oxide, wherein the inert anode comprises an oxide of nickel, iron and aluminum having an electrical conductivity of at least 0.25 S/cm at a temperature between 900° C. and 1,000° C.; and recovering aluminum comprising a maximum of 0.2 weight percent Fe.

49. The method of claim 48, wherein the recovered aluminum comprises loss than 0.18 weight percent Fe.

50. The method of claim 48, wherein the recovered aluminum comprises a maximum of 0.034 weight percent Ni.

51. The method of claim 48, wherein the recovered aluminum comprises less than 0.15 weight percent Fe, 0.034 weight percent Cu, and 0.03 weight percent Ni.

52. The method of claim 48, wherein the recovered aluminum comprises a maximum of 0.13 weight percent Fe, 0.03 weight percent Cu, and 0.03 weight percent Ni.

53. The method of claim 48, wherein the oxide of nickel, iron and aluminum has an aluminum mole ratio Al/(Ni+Fe+Al) of up to about 0.76, a nickel mole ratio Ni/(Ni+Fe+Al) of from about 0.2 to about 0.6, and an iron mole ratio Fe/(Ni+Fe+Al) of from about 0.02 to about 0.8.

54. The method of claim 48, wherein the oxide of nickel, iron and aluminum has an aluminum mole ratio Al/(Ni+Fe+Al) of from about 0.001 to about 0.713, a nickel mole ratio Ni/(Ni+Fe+Al) of from about 0.25 to about 0.35, and an iron mole ratio Fe/(Ni+Fe+Al) of from about 0.032 to about 0.75.

55. The method of claim 48, wherein the oxide of nickel, iron and aluminum has an aluminum mole ratio Al/(Ni+Fe+Al) of from about 0.005 to about 0.684, a nickel mole ratio Ni/(Ni+Fe+Al) of from about 0.28 to about 0.33, and an iron mole ratio Fe/(Ni+Fe+Al) of from about 0.033 to about 0.72.

56. The method of claim 48, wherein the oxide of nickel, iron and aluminum further includes up to about 90 weight percent of an additive.

57. The method of claim 56, wherein the additive comprises at least one material selected from Al, Co, Cr, Ga, Ge, Hf, In, Ir, Mo, Mn, Nb, Os, Re, Rh, Ru, Se, Si, Sn, Ti, V, W, Zr, Li, Ca, Ce, Y and F, and oxides thereof.

58. The method of claim 48, wherein the inert anode comprises a monolithic body of the oxide of nickel, iron and aluminum.

59. The method of claim 48, wherein the inert anode comprises a surface coated wit the oxide of nickel, iron and aluminum.

* * * * *